US008646773B2

(12) United States Patent
Wright

(10) Patent No.: US 8,646,773 B2
(45) Date of Patent: Feb. 11, 2014

(54) DEVICE AND METHOD FOR SHEET DOCUMENT PROCESSING

(75) Inventor: Robert Wright, Essex (GB)

(73) Assignee: Cash Dynamics Limited, Ilford, Essex (GB)

( * ) Notice: Subject to any disclaimer, the term of this patent is extended or adjusted under 35 U.S.C. 154(b) by 0 days.

(21) Appl. No.: 13/498,599

(22) PCT Filed: Sep. 28, 2010

(86) PCT No.: PCT/GB2010/051613

§ 371 (c)(1), (2), (4) Date: Mar. 28, 2012

(87) PCT Pub. No.: WO2011/039532

PCT Pub. Date: Apr. 7, 2011

(65) Prior Publication Data

US 2012/0187619 A1 Jul. 26, 2012

(30) Foreign Application Priority Data

Sep. 30, 2009 (GB) ..... 0917115.8

(51) Int. Cl.
*B65H 29/34* (2006.01)

(52) U.S. Cl.
USPC ..... 271/189; 271/315; 271/177

(58) Field of Classification Search
USPC ..... 271/189, 191, 315, 177
See application file for complete search history.

(56) References Cited

U.S. PATENT DOCUMENTS

| | | | | |
|---|---|---|---|---|
| 4,884,698 | A | 12/1989 | Tutamune et al. | |
| 6,439,395 | B1 | 8/2002 | Voellmer et al. | |
| 7,523,927 | B2 * | 4/2009 | Stansch | 271/81 |
| 7,591,465 | B2 * | 9/2009 | Sato | 271/187 |
| 2005/0087925 | A1 * | 4/2005 | Michler et al. | 271/315 |
| 2005/0242498 | A1 * | 11/2005 | Sato | 271/302 |
| 2006/0039728 | A1 | 2/2006 | deJong et al. | |
| 2008/0149698 | A1 | 6/2008 | Gauselmann | |
| 2009/0014938 | A1 * | 1/2009 | Herda et al. | 270/42 |

FOREIGN PATENT DOCUMENTS

| | | | |
|---|---|---|---|
| EP | 0164717 | A2 | 12/1985 |
| EP | 1 445 223 | A1 | 8/2004 |
| WO | 2007005777 | A2 | 1/2007 |

OTHER PUBLICATIONS

International Search Report in International Patent Application No. PCT/GB2010/051613 (mailing date Dec. 28, 2010).

* cited by examiner

*Primary Examiner* — David H Bollinger
(74) *Attorney, Agent, or Firm* — Vaincent K. Gustafson; Jenkins, Wilson, Taylor & Hunt, P.A.

(57) ABSTRACT

A device (1) for conveying sheet documents between upstream and downstream sheet document processors is disclosed. The device (1) is independent from the upstream and downstream sheet document processors and comprises a receiving section (4) adapted to receive, in use, sheet documents discharged by the upstream sheet document processor into an output pocket of the upstream sheet document processor, and a transport (7, 8) extending from the receiving section (4) to an output section (26). The transport (7, 8) is adapted to convey sheet documents received at the receiving section (4) to the output section (26). The sheet documents are then discharged from the output section (26), in use, to the downstream sheet document processor. A corresponding method is also disclosed.

16 Claims, 6 Drawing Sheets

DEVICE AND METHOD FOR SHEET DOCUMENT PROCESSING

CROSS-REFERENCE TO RELATED APPLICATIONS

This application is filed under the provisions of 35 U.S.C. §371 and claims the priority of International Patent Application No. PCT/GB2010/051613 filed on Sept. 28, 2010, and of United Kingdom Patent Application No. 0917115.8 filed on Sept. 30, 2009. The disclosures of the foregoing international patent application and United Kingdom patent application are hereby incorporated by reference herein in their respective entireties for all purposes.

This invention relates to a device and a method for processing sheet documents, and in particular to a device and method for conveying sheet documents from an upstream sheet document processor to a downstream sheet document processor.

Sheet document processors are used for a variety of purposes such as for processing banknotes. A variety of banknote counters and sorters is available on the market. These machines typically receive a bundle of banknotes in a feed hopper and then feed each note in the bundle into the machine. The machine may simply count the notes as they are fed through it to an output pocket. However, if the machine has a sorting capability then sensors within the machine will detect various characteristics of the notes as they are conveyed along a transport mechanism and activate one of a set of diverters to divert the banknote from the transport into an appropriate output pocket where they are deposited, often using a stacking operation performed by so-called tine-wheels.

There are often two or three output pockets for receiving notes with different characteristics, and there is also typically a cull pocket for receiving notes which do not have the characteristics associated with any of the output pockets. The characteristics detected may be any one or more of currency, denomination value, fitness, orientation and facing alongside various other characteristics which will be know to those skilled in the art. The notes deposited in the output and/or cull pockets are manually retrieved by an operator for appropriate further processing, for example destruction if the notes are unfit or counterfeit or recirculation in sorted bundles of each denomination detected in the original bundle.

Often the bundles of notes that are to be sent for destruction or recirculated are sealed into bags for easy and secure handling. Security of the recirculation and destruction cycles is clearly of vital importance; it is essential that all notes destined for recirculation or destruction arrive safely at their intended destination. Thus, it is highly desirable that the number of opportunities for pilfering or tampering with the sorted or counted bundles is minimised. The handling of sorted or counted bundles by staff during the bag sealing process presents such an opportunity, and it is necessary to provide extensive security and auditing processes to oversee the process as a result. Furthermore, the manual handling processes are labour intensive.

One possibility for removing the manual handling of sorted or counted bundles is to use a bag sealer which can be retrofitted to an existing sorter or counter. Such a bag sealer is described in our co-pending British application number 0907252.1. However, many counters and sorters, especially desktop machines, are not sufficiently large to receive this type of bag sealer and owners are naturally reluctant to allow modification of the machines to allow retrofitting as this invalidates any warranty associated with the machines and is an expensive and irreversible process.

Thus, there exists a need to enhance the security and efficiency of processing performed by traditional sheet document processors, such as counters and sorters.

In accordance with a first aspect of the invention, there is provided a device for conveying sheet documents between upstream and downstream sheet document processors, the device being independent from the upstream and downstream sheet document processors and comprising a receiving section adapted to receive, in use, sheet documents discharged by the upstream sheet document processor into an output pocket of the upstream sheet document processor, and a transport extending from the receiving section to an output section, the transport being adapted to convey sheet documents received at the receiving section to the output section, the sheet documents being discharged from the output section, in use, to the downstream sheet document processor.

Thus, no operator is required for counted or sorted documents to be conveyed from the output pockets of a counter or sorter to a bag sealer or other downstream processing device. The integrity of sheet document processing is therefore maintained and the efficiency of processing is enhanced.

The invention effectively increases the operations that a counter or sorter or other sheet document processor can perform without modification even if the process was not envisaged when the sheet document processor was originally conceived. The warranty of sheet document processors is therefore not affected by application of a device according to this invention.

Furthermore, the volume of the downstream sheet document processor, which may be for example a bag sealer, is no longer of any relevance as it is not necessary to retrofit it within the upstream sheet document processor in order for the two to co-operate without manual intervention.

In this application, the downstream and upstream sheet document processors are defined as being independent of the device according to the invention. This does not mean that the device cannot be mechanically or electrically coupled to the downstream and/or upstream sheet document processors. This may be necessary to control operation of drive motors and the like within the device and to hold the device and the downstream and/or upstream processors in fixed positions for correct operation. What is meant is that the device and the downstream and upstream sheet document processors are each separate, self-contained devices or machines.

It is also stated that sheet documents discharged by the upstream sheet document processor into an output pocket of the upstream sheet document processor are received in use by the device according to this invention. This should not be interpreted as a requirement that the sheet documents are actually deposited in the output pocket, but simply that the documents have been allocated or destined for deposition in the output pocket by the upstream sheet document processor. They may be deposited in the output pocket before they are received by the device, or they may be received by interception by the device before they are deposited in the output pocket.

In one embodiment, the receiving section comprises a receiving plate on which sheet documents discharged by the upstream sheet document processor can be deposited, in use.

In this embodiment, the receiving plate typically extends from a free end for placement proximal to the output pocket of the upstream sheet processor to an inboard end proximal to the transport.

In this embodiment, the receiving plate preferably acts to dislodge sheet documents from at least one tine wheel on the upstream sheet document processor, the tine wheels being suitable for stacking sheet documents in the output pocket.

Thus, the sheet documents are dislodged before they are deposited in the output pocket, and the device effectively receives the sheet documents by interception of the deposition process of the sheet documents in the output pocket that is usually performed by the tine wheels.

The receiving plate is preferably provided with one or more slots in the free end through which the tine wheels may pass, in use.

Preferably, the receiving plate is shaped so as to conform to the shape of the output pocket. Thus, the profile of the receiving plate conforms to that of the output pocket so that the receiving plate can be easily fitted within the output pocket, for example in order to intercept the sheet documents before they are deposited in the output pocket, without modification to the output pocket or causing surface damage to the output pocket by scratching, for example.

Typically, the transport comprises at least one pair of opposed feed rollers, which define a nip for engaging sheet documents received by the receiving section and feeding the sheet documents into the transport.

The or each pair of opposed feed rollers may comprise a driving feed roller mounted on a first feed roller shaft and a driven feed roller mounted on a second feed roller shaft, the second feed roller shaft being freely rotatable such that as the or each driving feed roller rotates, the or each driven feed roller rotates in the opposite sense.

Typically, the transport comprises at least one pair of opposed output rollers, which define a nip for receiving sheet documents fed into the transport and feeding the sheet documents to the output section.

The or each pair of opposed output rollers may comprise a driving output roller mounted on a first output roller shaft and a driven output roller mounted on a second output roller shaft, the second output roller shaft being freely rotatable such that as the or each driving output roller rotates, the or each driven output roller rotates in the opposite sense.

Typically, the first output roller shaft is mechanically coupled, for example by a belt, to the first feed roller shaft so that the first feed roller shaft rotates in synchrony with the first output roller shaft. Although, in this case the first feed roller shaft and first output roller shaft rotate in synchrony, they could rotate at different speeds, for example by having different diameter pulleys driven by the belt. It may be advantageous in some cases to ensure that the feed roller shaft rotates slightly faster for efficient feeding of sheet documents from the output pocket in an effort to prevent documents stacking in the output pocket which could lead to feeding of overlapped documents and jamming.

Typically, the second output roller shaft and second feed roller shaft are driven from the first output roller shaft and first feed roller shaft respectively by friction alone (either directly or transmitted via a sheet document when one is between the rollers), and thus all the rollers rotate together in this case.

Typically, the first output roller shaft is driven by a motor. However, it will be appreciated that any of the other shafts could be driven by the motor instead. The motor could be any type of motor, such as a DC motor or a stepper motor. It's rotor is typically coupled to the relevant shaft by a belt.

In one embodiment, the at least one pair of opposed output rollers is disposed so as to receive sheet documents directly from the or each pair of opposed feed rollers.

In this case, the or each pair of opposed output rollers may be spaced apart from the or each pair of opposed feed rollers such that the nips defined by the feed rollers and the output rollers are separated by a distance less than the shortest edge of a sheet document suitable for processing by the device.

Preferably, the transport comprises upper and lower sheet document guides, which together define a transport path along which sheet documents are conveyed between the receiving section and the output section, the upper and lower sheet document guides enclosing the transport path such that the sheet documents are inaccessible whilst being conveyed from the receiving section to the output section.

Typically, the output section is adapted to couple to a sheet document receiving section of the downstream sheet document processor.

Preferably, the output section comprises a housing having an aperture in a side wall, which defines the extent of the transport, and an open bottom through which the sheet documents are discharged, in use.

Thus, the transport terminates at the side aperture and the notes are released into the output section at this point The housing may be provided with ventilation holes.

Preferably, the device further comprises a base plate on which the upstream sheet document processor may be placed in use, the base plate being adapted to cause the receiving section to lie in a suitable position for receiving notes discharged by the upstream sheet document processor into the output pocket.

In a preferred embodiment, the receiving section comprises a vacuum port for attracting sheet documents discharged by the upstream sheet document processor into the output pocket and a sheet document feeder for engaging sheet documents drawn towards the vacuum port and urging them towards the transport.

This preferred embodiment has been found particularly beneficial as it is more tolerant to the accumulation of sheet documents in the output pocket, the sheet documents simply stacking up in the output pocket and being drawn towards the vacuum port one by one as preceding sheet documents are fed into the transport by the sheet feeder. The vacuum port has also been found to handle crinkled notes particularly well.

In a first variant of this preferred embodiment, the device typically further comprises at least one feed roller for engaging sheet documents drawn towards the vacuum port and urging them towards the transport. The or each feed roller may be conveniently located in the vacuum port.

The or each feed roller typically comprises a cam portion which extends around a section of the circumference of the roller, the cam portion having a larger radius than the remainder of the roller.

The vacuum port normally forms an aperture in a receiving surface against which sheet documents are drawn by the vacuum port.

In a second variant of this preferred embodiment, the sheet document feeder preferably comprises at least one feed belt, the or each feed belt having a raised portion for engaging sheet documents; and a drive mechanism adapted to drive the or each feed belt such that the or each raised portion runs along a path parallel to a receiving surface against which sheet documents are drawn by the vacuum port, thereby engaging a sheet document drawn against the receiving surface, in use.

This second variant is useful because the length of the belt can be selected to provide a specific dwell time, which allows the separation between each note fed into the transport to be accurately controlled. The dwell time is the period between each successive pass of the raised portions as the belt rotates. Thus, it depends on the belt length (at a given speed) alone.

With the first variant, the dwell time can only be controlled by selecting the diameter of the feed rollers and the length of the circumference of the feed roller over which the cam portion extends. There are other factors such as the size of notes to be handled which also affect how these parameters must be selected, and this makes it impossible to independently control the dwell time.

The length of the path parallel to the receiving surface over which the raised portions run determines the length over which sheet documents attracted to the receiving surface by the vacuum port are engaged for. Thus, this length determines the range of sizes of sheet documents that can be accommodated.

The or each raised portion is typically formed of a natural or silicone rubber material.

The or each belt is preferably a toothed belt entrained around a pair of pulleys, the separation of the pulleys defining the path parallel to a receiving surface.

The use of toothed belts prevents belts slipping. This is helpful when more than one belt is used to prevent the raised portions slipping with respect to one another, which might cause sheet documents to be fed in a skewed manner.

The or each raised portion normally protrudes through a respective slot in the receiving surface as it runs along the path parallel to a receiving surface.

The or each slot typically forms the vacuum port.

The or each belt may be entrained around a respective auxiliary roller.

The use of an auxiliary roller allows excess belt length to be taken up without requiring an increase in the separation of the pulleys. This allows the length of the belt, which controls the dwell time, to be selected independently of the separation between the pulleys, which controls the length of the path parallel to the receiving surface over which the raised portions run and hence the size of sheet documents that can be accommodated.

In both the first and second variants of this preferred embodiment, the shape of the receiving surface may conform to a portion of the output pocket shaped to allow an operator to retrieve documents deposited in the output pocket. This portion of the output pocket is typically a cut-out formed in the front edge of the output pocket so that an operator's fingers can easily pick up the notes deposited in the output pocket.

The transport may comprise a longitudinal roller and at least one input roller, the or each input roller being opposed to the longitudinal roller, thereby defining a respective nip for engaging sheet documents urged towards the transport by the feed rollers.

Preferably, the longitudinal roller is formed of a plurality of spaced apart wheels. This arrangement is particularly good at handling old, crinkled documents.

Typically, the longitudinal roller and the or each input roller is driven by a motor. The feed rollers may also driven by the motor.

The output section may comprise a housing having an aperture in a side wall, which defines the extent of the transport, the housing being adapted to house the downstream sheet document processor. In this case, the housing is preferably provided with ventilation holes.

The device may further comprise a cover adapted to fit over the output pocket of the upstream sheet document processor in use to prevent access to sheet documents discharged into the output pocket.

Typically, the sheet documents are banknotes or other security documents.

In a typical deployment of the invention, the upstream sheet document is a counter or sorter, typically for banknotes. The downstream sheet document is typically a bag sealer.

In a second aspect of the invention, there is provided a method for conveying sheet documents between upstream and downstream sheet document processors, the method comprising receiving, in use, sheet documents discharged by the upstream sheet document processor into an output pocket of the upstream sheet document processor in a receiving section of a device which is independent of the upstream and downstream sheet document processors, conveying the received sheet documents from the receiving section of the device to an output section of the device, and discharging the sheet documents from the output section, in use, to the downstream sheet document processor.

Typically, the sheet documents are conveyed from the receiving section of the device to an output section of the device by a transport extending from the receiving section to an output section.

In one embodiment, the sheet documents are received in the receiving section by dislodging the sheet documents from at least one tine wheel on the upstream sheet document processor before the sheet documents are deposited in the output pocket, the tine wheels being suitable for stacking sheet documents in the output pocket.

Thus, as mentioned above the sheet documents are dislodged before they are deposited in the output pocket, and the method involves receiving the sheet documents by interception of the deposition process of the sheet documents in the output pocket that is usually performed by the tine wheels.

In another embodiment, the sheet documents are received in the receiving section by attracting sheet documents discharged by the upstream sheet document processor into the output pocket towards the receiving section by way of a vacuum.

In this embodiment, the output pocket of the upstream sheet document processor can act as a buffer store for holding the sheet documents whilst they await further processing, and there is no need for immediate processing of the sheet documents to prevent jams occurring.

Preferably, the sheet documents are conveyed from the receiving section of the device to an output section of the device along a transport path, the method further comprising enclosing the transport path such that the sheet documents are inaccessible whilst being conveyed from the receiving section to the output section.

The method may further comprise coupling the output section of the device to a sheet document receiving section of the downstream sheet document processor.

Preferably, the method further comprises covering the output pocket of the upstream sheet document processor in use to prevent access to sheet documents discharged into the output pocket.

The sheet documents are typically banknotes or other security documents.

The vacuum port embodiment mentioned above may be adapted to form a feed system for sheet document processing equipment more generally, such as banknote counters, sorters and recyclers.

In accordance with a third aspect of the invention, there is provided a feed system for sheet document processing equipment, the feed system comprising a vacuum port for attracting sheet documents and a sheet document feeder for engaging sheet documents drawn towards the vacuum port and urging them towards a transport in the sheet document processing equipment.

This third aspect results in a feed system for sheet document processing equipment that is capable of reliably feeding sheet documents singly from a stack placed adjacent the vacuum port. The sheet documents are drawn towards the vacuum port one by one as preceding sheet documents are fed into the transport by the sheet feeder. The system also handles crinkled notes particularly well.

In a first embodiment, the sheet document feeder comprises at least one feed roller.

The or each feed roller is preferably located in the vacuum port.

Typically, the or each feed roller comprises a cam portion which extends around a section of the circumference of the roller, the cam portion having a larger radius than the remainder of the roller.

Normally, the vacuum port forms an aperture in a receiving surface against which sheet documents are drawn by the vacuum port.

In a preferred embodiment, the sheet document feeder comprises at least one feed belt, the or each feed belt having a raised portion for engaging sheet documents; and a drive mechanism adapted to drive the or each feed belt such that the or each raised portion runs along a path parallel to a receiving surface against which sheet documents are drawn by the vacuum port, thereby engaging a sheet document drawn against the receiving surface, in use.

This preferred embodiment is useful because the length of the belt can be selected to provide a specific dwell time, which allows the separation between each note fed into the transport to be accurately controlled. The dwell time is the period between each successive pass of the raised portions as the belt rotates. Thus, it depends on the belt length (at a given speed) alone.

With the first embodiment, the dwell time can only be controlled by selecting the diameter of the feed rollers and the length of the circumference of the feed roller over which the cam portion extends. There are other factors such as the size of notes to be handled which also affect how these parameters must be selected, and this makes it impossible to independently control the dwell time.

The length of the path parallel to the receiving surface over which the raised portions run determines the length over which sheet documents attracted to the receiving surface by the vacuum port are engaged for. Thus, this length determines the range of sizes of sheet documents that can be accommodated.

The or each raised portion is typically formed of a natural or silicone rubber material.

Preferably, the or each belt is a toothed belt entrained around a pair of pulleys, the separation of the pulleys defining the path parallel to a receiving surface.

The use of toothed belts prevents belts slipping. This is helpful when more than one belt is used to prevent the raised portions slipping with respect to one another, which might cause sheet documents to be fed in a skewed manner.

Typically, the or each raised portion protrudes through a respective slot in the receiving surface as it runs along the path parallel to a receiving surface.

Preferably, the or each slot forms the vacuum port.

The or each belt may be entrained around a respective auxiliary roller.

The use of an auxiliary roller allows excess belt length to be taken up without requiring an increase in the separation of the pulleys. This allows the length of the belt, which controls the dwell time, to be selected independently of the separation between the pulleys, which controls the length of the path parallel to the receiving surface over which the raised portions run and hence the size of sheet documents that can be accommodated.

Embodiments of the invention will now be described with reference to the accompanying drawings, in which.

Figure 1:
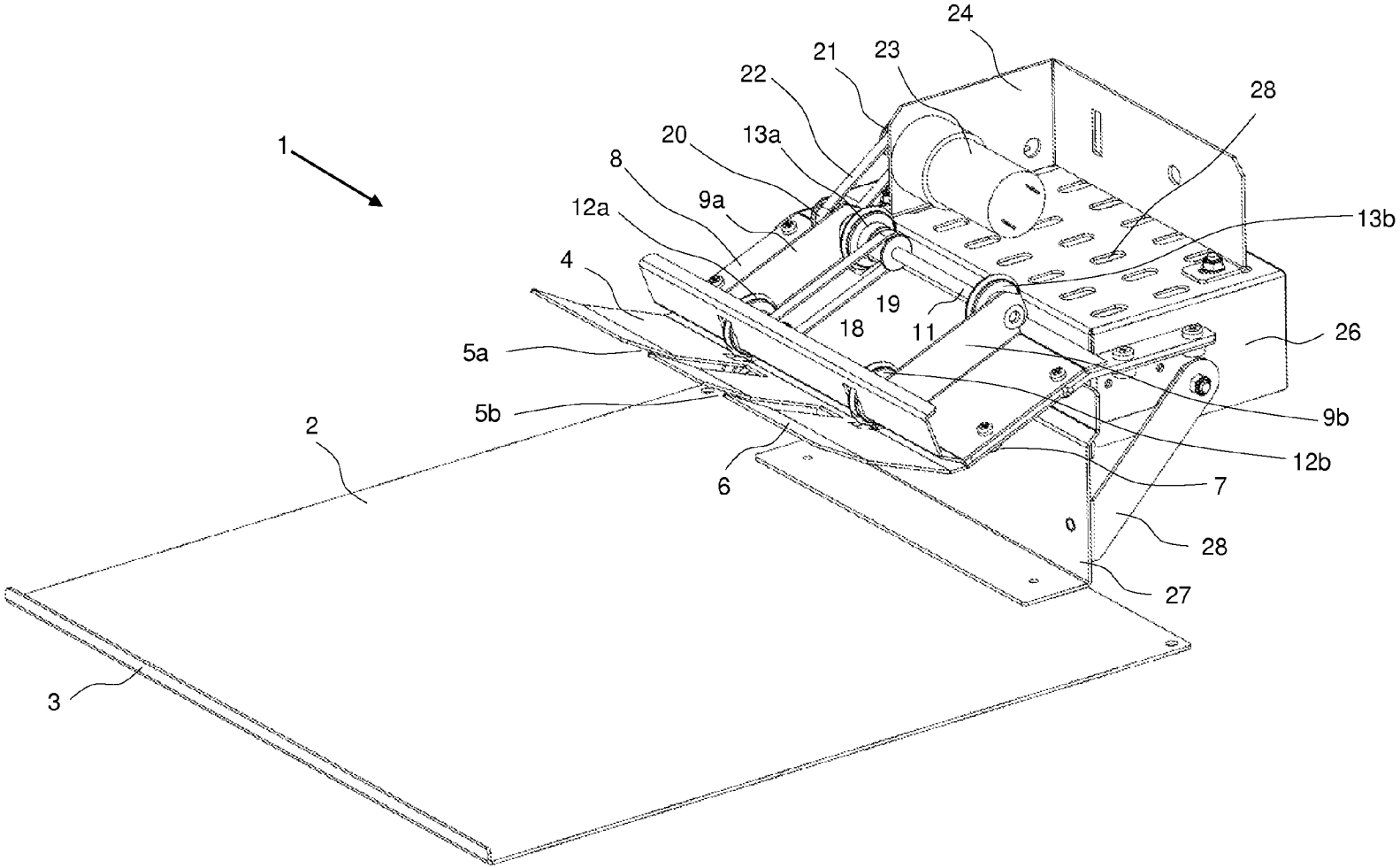
FIG. 1 shows a perspective view of a device according to a first embodiment of the invention.

FIG. 1 shows a device 1, according to a first embodiment of the invention, for conveying sheet documents such as banknotes or other security documents between an upstream sheet document processor, such as a banknote sorter or counter, and a downstream sheet document processor, such as a bag sealer. The device 1 is shown in isolation in this view; the upstream and downstream sheet document processors are not shown in FIG. 1.

The device 1 comprises a base plate 2 on which all the other components of the device 1 are mounted. The base plate 2 provides a convenient surface on which the upstream sheet processor can be placed in use. A lip 3 is provided, which prevents the upstream sheet processor from being pushed off the rear edge of the base plate 2. By pushing the upstream sheet processor against the lip 3, the correct registration of a receiving plate 4 with the output pocket of the upstream sheet document processor is easily set and maintained.

The receiving plate 4 acts as a surface against which notes may be dislodged from a pair of tine wheels in the output pocket of the upstream sheet document processor. For this purpose, the receiving plate 4 has two slots 5*a* and 5*b* in its free end 6 through which the tine wheels pass as they rotate. The receiving plate 4 thus, dislodges sheet documents carried in the tines of the tine wheels as they rotate and prevent documents discharged by the upstream sheet document from being deposited in the output pocket of the upstream sheet document processor. This process will be explained more elaborately below with reference to FIG. 2, which shows one of the tine wheels.

The receiving plate 4 is formed as a continuation of a lower sheet document guide 7. This is connected to an upper sheet document guide 8 and together the lower and upper sheet document guides 7 and 8 define a transport path along which sheet documents dislodged by the receiving plate 4 are conveyed. The close coupling of the lower and upper sheet document guides 7 and 8 prevents any access to the sheet documents whilst being conveyed along the transport path.

Figure 2:
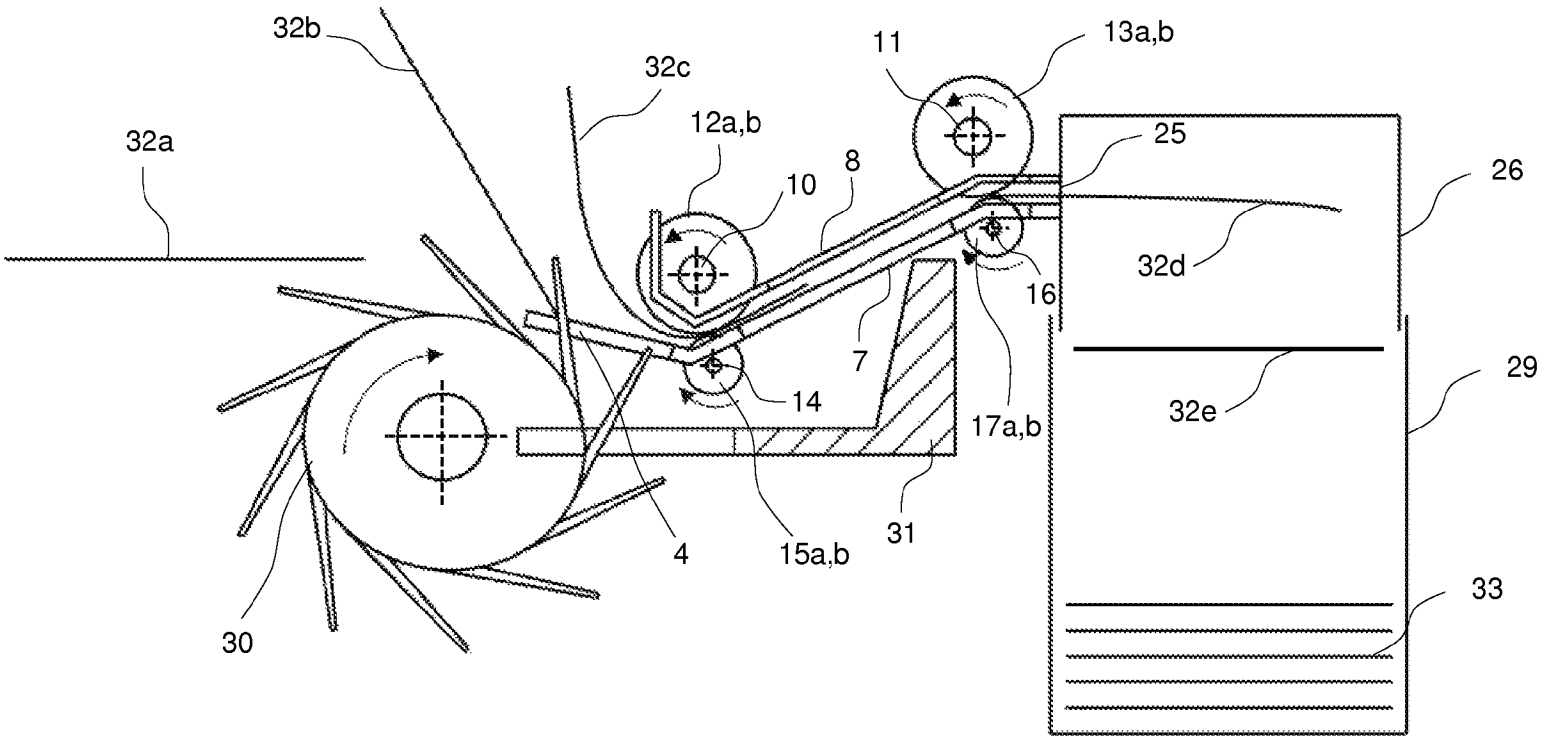
FIG. 2 shows a sectional view of the device according to the first embodiment deployed with a sorter and bag sealer.

The remainder of the transport components are best seen in FIG. 2, although to the extent that they are visible they are shown in FIG. 1 as well. The transport comprises a feed roller drive shaft 10 and an output roller drive shaft 11. Each of these drive shafts 10 and 11 is rotatably mounted in support plates 9*a* and 9*b*, which are mounted on the upper sheet document guide 8. The feed roller drive shaft 10 has a pair of feed rollers 12*a* and 12*b* mounted on it, and the output roller drive shaft 11 has a pair of output rollers 13*a* and 13*b* mounted on it.

Each of the feed rollers 12*a* and 12*b* co-operates with one of a corresponding pair of feed rollers 15*a* and 15*b* mounted in opposition on a feed roller driven shaft 14 which is situated under the lower sheet document guide 7 and is freely rotatable. Similarly, each of the output rollers 13*a* and 13*b* co-operates with one of a corresponding pair of feed rollers 17*a* and 17*b* mounted in opposition on a feed roller driven shaft 16 which is situated under the lower sheet document guide 7 and is freely rotatable. Thus, the feed rollers 15*a* and 15*b* are frictionally coupled with feed rollers 12*a* and 12*b* and therefore rotate when feed rollers 12*a* and 12*b* rotate. Similarly, the output rollers 17*a* and 17*b* are frictionally coupled with output rollers 13*a* and 13*b* and therefore rotate when output rollers 13*a* and 13*b* rotate. The feed and output rollers 12*a*, 12*b*, 15*a*, 15*b*, 13*a*, 13*b*, 17*a* and 17*b* are typically made of rubber.

The feed rollers 12*a* and 12*b* together with feed rollers 15*a* and 15*b* form nips to entrap sheet documents received on the receiving tray and feed them in between the upper and lower sheet document guides 7 and 8. Similarly, the feed rollers 13*a* and 13*b* together with feed rollers 17*a* and 17*b* form nips to entrap sheet documents fed into the transport by the feed rollers 12*a*, 12*b*, 15*a* and 15*b* and feed them onwards into the output section of the device. The output rollers 13*a*, 13*b*, 17*a* and 17*b* are spaced apart from the feed rollers 12*a*, 12*b*, 15*a* and 15*b* along the transport direction by a distance that is less than the shortest edge of a sheet document that is intended to be conveyed from the receiving plate 4 to the output section. This ensures that the sheet documents are always being actively transported and will not be dropped by the nips defined by the feed rollers 12*a*, 12*b*, 15*a* and 15*b* before being picked up by the nips defined by the output rollers 13*a*, 13*b*, 17*a* and 17*b*.

Each of the feed roller and output roller drive shafts 10 and 11 bears a toothed pulley 19 (the toothed pulley mounted on the feed roller drive shaft 10 is not visible in the figures) around which a toothed belt 18 is entrained to couple the feed roller and output roller drive shafts 10 and 11 together. A second toothed pulley 20 is mounted on the output roller drive shaft 11 and is coupled via a toothed belt 22 to a toothed pulley 21, which is mounted on the rotor of a motor 23. The motor 23 is mounted on a support plate 24. Thus, as motor 23 rotates, the feed and output roller drive shafts 10 and 11 rotate along with the feed rollers 12*a*, 12*b*, 15*a* and 15*b* and the output rollers 13*a*, 13*b*, 17*a* and 17*b*. Rotation of the motor 23 therefore controls conveyance of the documents received on the receiving plate 24 along the transport to an output section of the device.

The transport terminates at an aperture 25 in a housing 26, which defines the output section. Thus, documents conveyed along the transport are fed by the output rollers 13*a*, 13*b*, 17*a* and 17*b* through the aperture 25 into the output section defined by housing 26. The housing is mounted on base plate 2 by a support plate 27. A pair of support arms 28 (one each side) braces the weight of the housing 26 and the transport components and receiving plate, which are mounted on the housing 26, against the support plate 27 to prevent it buckling or vibrating under what would otherwise represent a heavy, cantilevered load.

The top of the housing 26 is perforated with an array of ventilation holes 28. These allow the passage of air into the housing 26 as a document discharged by the output rollers 13*a*, 13*b*, 17*a* and 17*b* through the aperture 25 falls vertically through the housing 26. This is desirable because the falling document could be a good fit to the interior of the housing 26 and act as a piston within the housing 26 so that air cannot pass around the falling document such that the falling document flutters and falls in a chaotic, unpredictable manner. The ventilation holes 28 stabilise the falling document by allowing air to circulate around the document through the top of the housing.

The function of the device 1 is best appreciated from FIG. 2, which schematically shows some features of the upstream sheet document processor, in this case a banknote sorter, and a downstream sheet document processor 29, in this case a bag sealer. The particular operation of the bag sealer is neither described nor illustrated in detail here, but a full description is available from our co-pending British patent application number 0907252.1, which is incorporated herein by reference.

The elements of the banknote sorter that are shown are a tine wheel 30 and an output pocket 31. In normal operation banknotes that are to be diverted into the output pocket 31 by the banknote sorter are received between an adjacent pair of tines in the tine wheel 30. As the tine wheel 30 rotates in the direction shown by the arrow in FIG. 2, the note is dislodged by the bottom wall of the output pocket 31. As several notes are deposited in this manner they shuffle forwards to the front wall of the output pocket 31 where they form a stack of vertically-oriented banknotes. However, when the device 1 is in position as shown in FIG. 2, the operation of the combination of the banknote sorter, device 1 and bag sealer 29 is as described below.

A banknote diverted from the transport in the banknote sorter for stacking in the output pocket 31 is received between two adjacent tines of the tine wheel 30 as shown by the banknote at position 32*a*. Further rotation of the tine wheel 30 causes the banknote to reach the position shown at 32*b* where it impinges on the receiving plate 4, which dislodges the banknote before it is deposited in the output pocket 31. Yet further rotation of the tine wheel 30 causes the banknote to be released from the tines entirely as they pass through the slots 5*a* and 5*b*, but the banknote is driven by the rotation of the tines down the receiving plate 4 towards the nip defined between the two pairs of feed rollers 12*a*, 12*b*, 15*a* and 15*b*. Position 32*c* shows the banknote after it has been engaged in this nip and fed a short way into the transport by rotation of the feed rollers 12*a*, 12*b*, 15*a* and 15*b*.

Further rotation of the feed rollers 12*a*, 12*b*, 15*a* and 15*b* causes the banknote to be conveyed along the transport path between the lower and upper guide plates 7 and 8 until it engages with the nips defined between the two pairs of output rollers 13*a*, 13*b*, 17*a* and 17*b*. The banknote is shown in position 32*d* as it is discharged by the output roller 13*a*, 13*b*, 17*a* and 17*b* through the aperture 25 into the output section defined by housing 26. The document then falls freely under gravity, as shown at position 32*e*, into the bag sealer 29 where it joins a stack 33 of banknotes already deposited in a bag, which is later sealed by the bag sealer 29.

Although not shown in the drawings, the entire device 1 would typically be enclosed in an outer housing to prevent operator contact or tampering with any of the interior parts. Also, a cover (possibly hinged) would normally be provided to fit over the output pocket 31. This prevents any notes flying from the output pocket 31, which could otherwise happen in the event of a jam and also restricts the possibility of tampering with the documents in the output pocket. A lock, which could only be operated by a supervisor, may be fitted to this cover to prevent the cover being withdrawn without authorisation, thereby further enhancing security.

Typically, the outer housing will be provided with features which engage with parts on the upstream and downstream sheet document processors to hold the device 1 and the upstream and downstream sheet document processors in fixed registration and alignment. This prevents the upstream and/or downstream sheet document processor separating from the device 1 and causing a malfunction, which may otherwise happen as a result of vibration or simply being knocked by an operator. The engagement features would engage with parts of the upstream and downstream sheet document processors without requiring modification or causing damage to either. Typically, a lock would be provided for the engagement features so that they could only be disengaged with supervisor approval. Alternatively, the lock may be applied by a controller on the upstream sheet document processor so that the device 1 is locked to it whilst processing of sheet documents is being carried out. When the processing is complete, the lock is released and the device 1 may be disengaged from the upstream sheet document processor for storage or redeployment elsewhere.

An interlock may also be provided to prevent the motor 23 from running unless the device 1 is correctly coupled and engaged with the upstream and downstream sheet document processors.

The operation of the motor 23 and hence the transport components in device 1 may be controlled by a simple switch. However, in a preferred variant the motor is controlled by a controller in the upstream and/or the downstream sheet document processor. With such a controller arrangement, it is possible to cause the motor 23 to run only when the upstream sheet document processor is actively discharging documents and/or only when the downstream sheet document processor can receive documents from the device 1.

Figure 3:
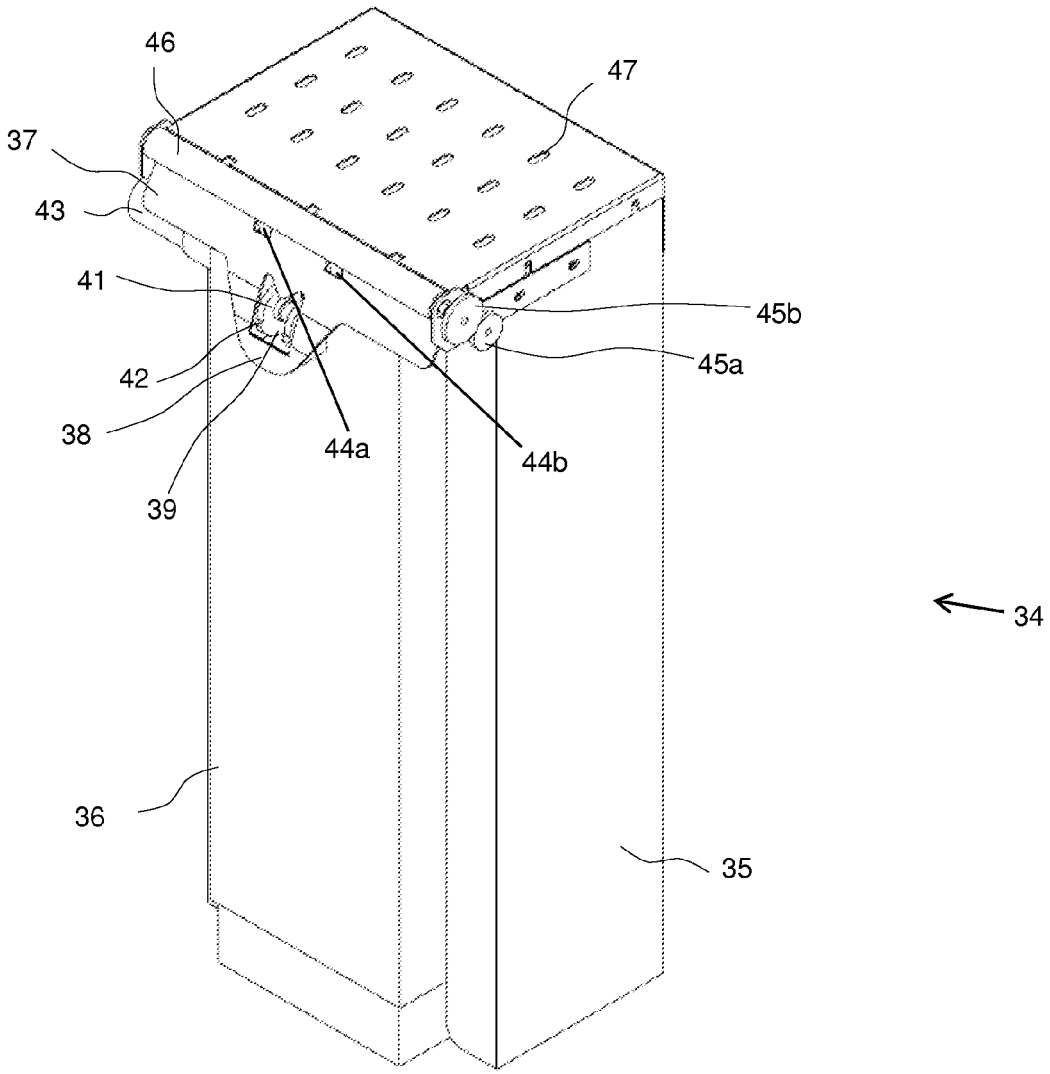
FIG. 3 shows a perspective view of a device according to a second embodiment of the invention.
Figure 4:
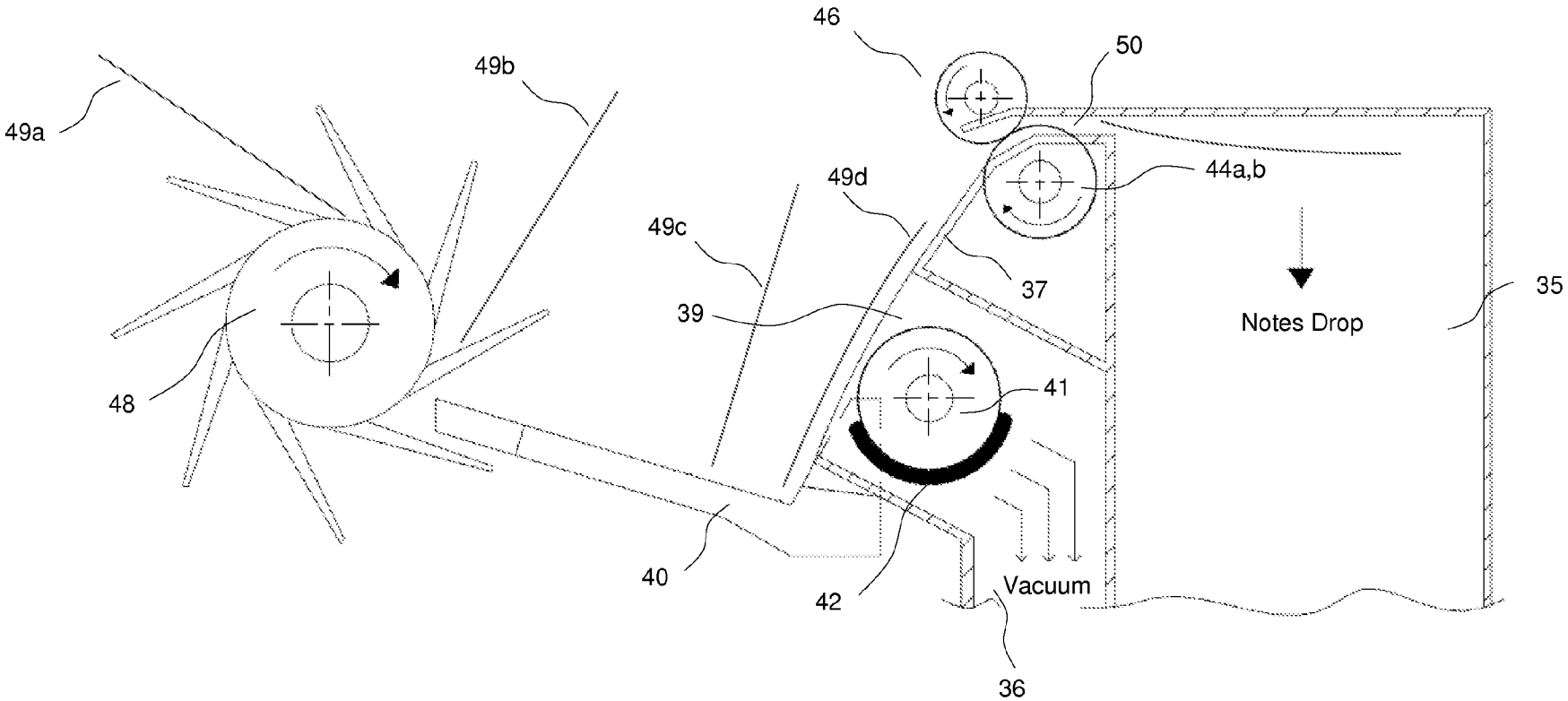
FIG. 4 shows a sectional view of the device according to the second embodiment in deployment.

FIGS. 3 and 4 illustrate a second embodiment of the invention in which a device 34 comprises a housing having a sheet document receiving portion 35 and a duct 36. In this embodiment, the sheet document receiving portion 35 acts as the output section of the device 34 and may house the downstream sheet document processor, for example a bag sealer. Alternatively, the sheet document receiving portion 35 may act as the downstream sheet document processor as well, in which case the documents are simply allowed to form a stack on the bottom of the sheet document receiving portion 35. A door may be provided in an outer housing (which is mentioned below) via which the stacked documents or downstream sheet document processor can be removed. This door may be provided with a lock so that access can be securely controlled.

A receiving surface 37 is situated at the top of the duct 36. In this embodiment, the receiving surface 37 does not intercept the sheet documents before they are deposited in the output pocket, but instead acts as a surface against which sheet documents can be drawn for alignment so that they can be fed into the device 34 in a manner which will be explained below.

The receiving surface 37 comprises a projecting portion 38. The projecting portion 38 has an vacuum port 39 at which the duct 36 terminates and through which a vacuum is drawn by a fan (not shown) situated at the bottom of duct 36. The receiving surface is shaped so as to fit into a relieved portion or cut-out in the output pocket 40 of the upstream sheet document processor. This relieved portion is typically provided around the midpoint along the width of the output pocket of sheet document processors to allow an operator to easily insert their fingers into the output pocket to pick up any document within the output pocket. The relieved portion therefore provides a convenient point for the device 34 to be brought up to and coupled to the sheet document processor and to provide some degree of registration between the two.

Within the vacuum port 39, there are situated a pair of rollers 41. The rollers 41 are smooth around the majority of their circumference, but a projecting cam 42 is provided on each roller around the remainder of the circumference, which provides a high grip surface for engaging documents drawn towards the vacuum port 39. The projecting cams 42 typically occupy 140° of the circumference of the rollers 41. Thus, as the rollers 41 rotate, the projecting cams 42 periodically project out of the vacuum port 39 to engage the documents drawn towards it. The rollers in the vacuum port are mounted on a shaft (not shown) which is coupled to a motor 43. Actuation of the motor 43 thereby causes the rollers 41 to rotate.

The motor 43 is coupled by a belt to a shaft on which a pair of rollers 44*a*, 44*b* are mounted. The shaft is coupled via a pair of gears 45*a*, 45*b* to a longitudinal roller 46. The longitudinal rollers 46 and each of the pair of rollers 44*a*, 44*b* rotate in opposing senses and form a pair of nips to engage sheet documents and feed them into the device 34. The longitudinal roller 46 is typically a segmented roller (for example, by forming it from a plurality of rubber-tyred wheels spaced apart along the longitudinal axis of the roller). This arrangement proves superior in handling older documents that may have become crinkled through use.

The top of the sheet document receiving portion 35 is provided with an array of apertures 47, which serve the purpose of stabilising the fall of the sheet documents as explained above with reference to the first embodiment.

The operation of the device 34 will now be explained with reference to FIG. 4. A document diverted from the transport of the upstream sheet document processor for deposition in the output pocket 40 will be picked up between two adjacent tines of the tine wheel 48. As the tine wheel 48 rotates, the document will move from position 49*a* round to position 49*b* and then will be deposited in the output pocket 40. The document will slide down the slope of the output pocket 40 (position 49*c*) in the usual manner and be drawn by the air rushing in to the vacuum port 39 against the receiving surface 37 (position 49*d*).

At this point, the document covers an optical sensor (not shown) in the receiving surface 37. This prevents ambient light reaching the optical sensor, and the presence of the document on the receiving surface can therefore be detected. In a variant of this embodiment, a reflective optical sensor can be used, in which an optical emitter emits optical radiation, which is reflected towards an optical detector only when a document is directly in front of it against the receiving surface 37.

When the presence of a document against the receiving surface 37 is detected by the optical sensor, a controller causes the motor 43 to be actuated, which causes rotation of the rollers 41 and of rollers 44*a*, 44*b* and 46. As rollers 41 rotate, the projecting cams 42 engage with the document in position 49*d* and urge it up the receiving surface 37 towards the nips defined by roller 44*a*, 44*b* and 46. The note is then engaged in these nips and rapidly fed into the sheet document receiving portion 35, where it is discharged by the rollers 44*a*, 44*b* and 46 through an aperture 50 and falls towards the downstream sheet document processor. The rollers 44*a*, 44*b* and 46 along with the aperture 50 thus form a transport of the device 34 extending between the receiving surface 37 and the sheet document receiving portion 35.

Since the projecting cams 42 only occupy a portion of the circumference of the rollers 41, there is a dwell before the next document is urged up the receiving surface 37 by the cams 42, and the sheet documents in the output pocket 40 are thus spaced apart by a suitable distance to ensure that no overlaps occur as the documents are fed through the nips between rollers 44*a*, 44*b* and 46.

When no documents are detected by the optical sensor, the controller switches the motor 43 off.

A significant advantage of this embodiment is that the output pocket 40 of the upstream sheet document processor acts as a buffer for the documents to be conveyed by the device 34. Immediate processing of the documents is therefore not required, and if a worn note slips back into the output pocket 40 it will not cause a jam. Furthermore, as a result of the buffering action, the device 34 does not need to run at the same speed or faster than the upstream sheet document processor; the speed is not critical to the proper operation of the device 34 and it can run slower than the upstream sheet document processor without any problems. Thus, no synchronisation between the device 34 and upstream sheet document processor is required.

Although not shown in the drawings, the entire device 34 would typically be enclosed in an outer housing to prevent operator contact or tampering with any of the interior parts. Also, a cover (possibly hinged) would normally be provided to fit over the output pocket 40. This prevents any notes flying from the output pocket 40, which could otherwise happen in the event of a jam and also restricts the possibility of tampering with the documents in the output pocket. A lock, which could only be operated by a supervisor, may be fitted to this cover to prevent the cover being withdrawn without authorisation, thereby further enhancing security.

Typically, the outer housing will be provided with features which engage with parts on the upstream sheet document processor to hold the device 34 and the upstream sheet document processor in fixed registration and alignment. This prevents the upstream sheet document processor separating from the device 34 and causing a malfunction, which may otherwise happen as a result of vibration or simply being knocked by an operator. The engagement features would engage with parts of the upstream sheet document processor without requiring modification or causing damage to it. Typically, a lock would be provided for the engagement features so that they could only be disengaged with supervisor approval. Alternatively, the lock may be applied by a controller on the upstream sheet document processor so that the device 34 is locked to it whilst processing of sheet documents is being carried out. When the processing is complete, the lock is released and the device 34 may be disengaged from the upstream sheet document processor for storage or redeployment elsewhere. As already explained, the downstream sheet document processor will normally be housed within the sheet document receiving portion 35, which is of course within the outer housing. Access to the sheet document receiving portion 35, and hence the downstream sheet document processor, will be provided by a locked door as discussed above.

An interlock may also be provided to prevent the motor 43 from running unless the device 34 is correctly coupled and engaged with the upstream and downstream sheet document processors.

Figure 5:
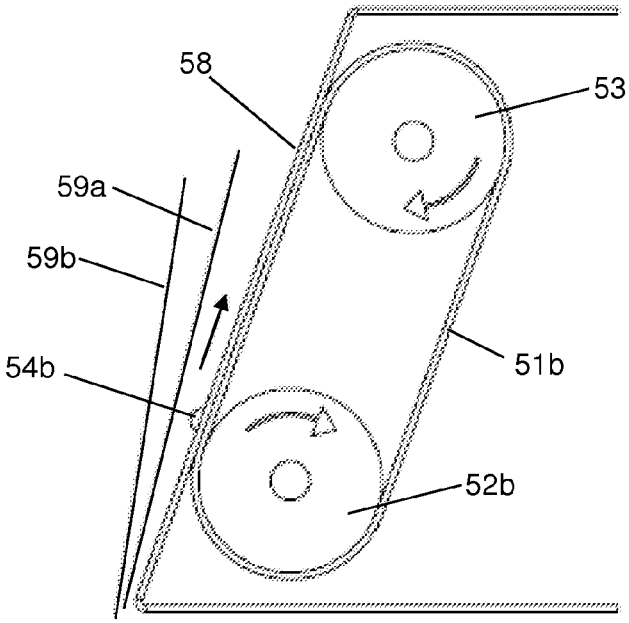
FIG. 5 shows a sectional view of the sheet feeder of a variant of the second embodiment.
Figure 6:
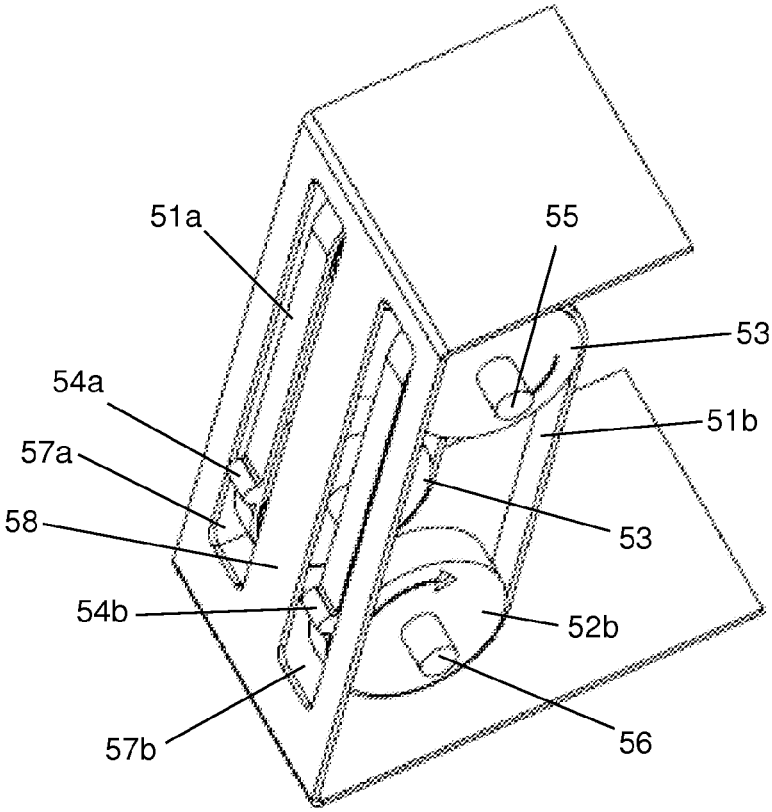
FIG. 6 shows an oblique sectional view of the sheet feeder of FIG. 5.

FIGS. 5 and 6 show sectional views of a variant of the embodiment shown in FIGS. 3 and 4. In this variant, the roller 41 in FIGS. 5 and 6 is replaced with a different type of sheet feeder, which makes use of belts.

In this variant, a pair of parallel belts 51*a* and 51*b* are entrained around a respective pair of pulleys 52*a*, 52*b* and 53 (the second pulley for belt 51*a* is not visible). Although not shown, each belt 51*a* and 51*b* is toothed, the teeth meshing with corresponding teeth (also not shown) on the pulleys 52*a*, 52*b* and 53. This prevents either belt 51*a* or 51*b* slipping with respect to the other and maintains alignment between the two raised portions 54*a* and 54*b* on the two belts 51*a* and 51*b*. The pulleys 52*a*, 52*b* and 53 are mounted on shafts 55 and 56, which are driven by a motor (not shown) to cause rotation of the pulleys 52*a*, 52*b* and 53.

As the pulleys 52*a*, 52*b* and 53 rotate, the raised portions 54*a* and 54*b* protrude through slots 57*a* and 57*b* in a face plate 58 of the device. The face plate 58 acts as a receiving surface against which banknotes 59*a* and 59*b* (or other sheet documents) may be drawn by the vacuum which is drawn through slots 57*a* and 57*b*. The vacuum may be drawn by a simple fan or similar device.

The raised portions 54*a* and 54*b* run along a path parallel to the face plate 58, the length of which is determined by the separation between the two pulleys 52*b* and 53 (in the case of belt 51*b*). Over this length the raised portions 54*a* and 54*b* may engage with banknotes 59*a* and 59*b* (or other sheet documents) drawn towards the face plate 58. The remainder of the belt length determines the dwell time, i.e. the time during which the raised portions 54*a* and 54*b* do not protrude through the slots 57*a* and 57*b*. This controls the separation between banknotes 59*a* and 59*b* as they pass through the transport. The dwell time can be increased without needing to change the length of the slots 57*a* and 57*b* or the path parallel to the face plate 58 over which the raised portions 54*a* and 54*b* run by increasing the length of the belts 51*a* and 51*b* and providing auxiliary pulleys or rollers to take up the additional length. In this way, it is not necessary to change the distance between pulleys 52*b* and 53 to take up the additional length.

The maximum size of sheet document that can be handled is determined by the length of the face plate 58 in the direction parallel to the motion of the belts 51*a* and 51*b*. By ensuring that the belts 51*a* and 51*b* run parallel to the face plate 58 (and thus, that the raised portions 54*a* and 54*b* protrude through the slots 57*a* and 57*b*) over the majority of this length, it is possible to handle much smaller notes as well. The minimum size is determined by the distance between the raised portions 54*a* and 54*b* and the rollers 44*a*, 44*b* and 46 when the raised portion 54*a* and 54*b* are at the highest point at which they still protrude sufficiently through slots 57*a* and 57*b* to engage the document.

Assuming a short-edge feed, this distance must be less than the short-edge dimension of the smallest document that must be handled. By judicious design of these parameters, it is possible to handle documents spanning over a large range of sizes.

The raised portions 54*a* and 54*b* are made of a material, such as a silicone or natural rubber, that will grip sheet documents well. Typically, the remaining portions of the belt are made from a smooth plastic material. The belts 51*a* and 51*b* may be made by co-moulding the silicone or natural rubber raised portions 54 and 54*b* with the smooth plastic used for the remainder of the belts 51*a* and 51*b*.

Whilst the embodiments of FIGS. 3 to 6 have been described as examples of the first and second aspects of the invention, it should be appreciated that their application is more general. Specifically, they also serve as exemplary embodiments of the third aspect of the invention, which relates more generally to a sheet feed system for sheet document processing equipment, such as banknote counters, sorters and recyclers.

The invention claimed is:

1. A device for conveying sheet documents between upstream and downstream sheet document processors, the device being separate from the upstream and downstream sheet document processors and comprising a receiving section adapted to receive, in use, sheet documents discharged by the upstream sheet document processor into an output pocket of the upstream sheet document processor, and a transport extending from the receiving section to an output section, the transport being adapted to convey sheet documents received at the receiving section to the output section, the sheet documents being discharged from the output section, in use, to the downstream sheet document processor; wherein the receiving section comprises a vacuum port for attracting sheet documents discharged by the upstream sheet document processor into the output pocket and a sheet document feeder for engaging sheet documents drawn towards the vacuum port and urging sheet documents towards the transport.

2. A device according to claim 1, wherein the sheet document feeder comprises at least one feed roller, the at least one feed roller being located in the vacuum port.

3. A device according to claim 2, wherein the at least one feed roller comprises a cam portion which extends around a section of the circumference of the roller, the cam portion having a larger radius than a remainder of the roller.

4. A device according to claim 2, wherein the vacuum port forms an aperture in a receiving surface against which sheet documents are drawn by the vacuum port.

5. A device according to claim 1, wherein the at least one feed roller comprises a cam portion which extends around a section of the circumference of the roller, the cam portion having a larger radius than a remainder of the roller.

6. A device according to claim 5, wherein the vacuum port forms an aperture in a receiving surface against which sheet documents are drawn by the vacuum port.

7. A device according to claim 1, wherein the vacuum port forms an aperture in a receiving surface against which sheet documents are drawn by the vacuum port.

8. A device according to claim 1, wherein the sheet document feeder comprises at least one feed belt, the at least one feed belt having a raised portion for engaging sheet documents; and a drive mechanism adapted to drive the at least one feed belt such that the raised portion of the at least one feed belt runs along a path parallel to a receiving surface against which sheet documents are drawn by the vacuum port, thereby engaging a sheet document drawn against the receiving surface, in use.

9. A device according to claim 8, wherein the raised portion of the at least one feed belt protrudes through a respective at least one slot in the receiving surface as the raised portion of the at least one feed belt runs along the path parallel to a receiving surface.

10. A device according to claim 9, wherein the at least one slot forms the vacuum port.

11. A method for conveying sheet documents between upstream and downstream sheet document processors, the method comprising receiving, in use, sheet documents discharged by the upstream sheet document processor into an output pocket of the upstream sheet document processor in a receiving section of a device which is separate from the upstream and downstream sheet document processors, conveying the received sheet documents from the receiving section of the device to an output section of the device, and discharging the sheet documents from the output section, in use, to the downstream sheet document processor, wherein the sheet documents are received in the receiving section by attracting sheet documents discharged by the upstream sheet document processor into the output pocket towards the receiving section by way of a vacuum.

12. A method for conveying sheet documents between upstream and downstream sheet document processors, the method comprising receiving, in use, sheet documents discharged by the upstream sheet document processor into an output pocket of the upstream sheet document processor in a receiving section of a device which is separate from the upstream and downstream sheet document processors, conveying the received sheet documents from the receiving section of the device to an output section of the device, and discharging the sheet documents from the output section, in use, to the downstream sheet document processor wherein the sheet documents are received in the receiving section by dislodging the sheet documents from at least one tine wheel on the upstream sheet document processor before the sheet documents are deposited in the output pocket, the at least one tine wheel being suitable for stacking sheet documents in the output pocket.

13. A device for conveying sheet documents between upstream and downstream sheet document processors, the device being separate from the upstream and downstream sheet document processors and comprising a receiving section adapted to receive, in use, sheet documents discharged by the upstream sheet document processor into an output pocket of the upstream sheet document processor, and a transport extending from the receiving section to an output section, the transport being adapted to convey sheet documents received at the receiving section to the output section, the sheet documents being discharged from the output section, in use, to the downstream sheet document processor, wherein the receiving section comprises a receiving plate on which sheet documents discharged by the upstream sheet document processor can be deposited, in use, and wherein the receiving plate extends from a free end for placement proximal to the output pocket of the upstream sheet document processor to an inboard end proximal to the transport.

14. A device according to claim 13, wherein the receiving plate acts to dislodge sheet documents from at least one tine wheel on the upstream sheet document processor, the at least one tine wheel being suitable for stacking sheet documents in the output pocket.

15. A device according to claim 14, wherein the receiving plate is provided with one or more slots in the free end through which the at least one tine wheel may pass, in use.

16. A device according to claim 13, wherein the receiving plate acts to dislodge sheet documents from at least one tine wheel on the upstream sheet document processor, the at least one tine wheel being suitable for stacking sheet documents in the output pocket.

* * * * *